US006466134B1

(12) United States Patent
Ahearn

(10) Patent No.: US 6,466,134 B1
(45) Date of Patent: Oct. 15, 2002

(54) CORDLESS MACHINE OPERATION DETECTOR

(75) Inventor: John Carrington Ahearn, Christchurch (NZ)

(73) Assignee: Trimble Navigation Limited, Sunnyvale, CA (US)

( * ) Notice: Subject to any disclaimer, the term of this patent is extended or adjusted under 35 U.S.C. 154(b) by 0 days.

(21) Appl. No.: 09/717,813

(22) Filed: Nov. 20, 2000

(51) Int. Cl.[7] ..... G08B 21/00

(52) U.S. Cl. ..... 340/683; 340/309.15; 340/679; 340/870.17

(58) Field of Search ..... 340/635, 679, 340/683, 686, 825.54, 870.17, 457.4, 309.15; 361/23; 318/490; 73/658, 660; 368/5

(56) References Cited

U.S. PATENT DOCUMENTS 4,559,828 A * 12/1985 Liszka ..... 73/658
5,003,518 A * 3/1991 Felder ..... 368/5
5,579,013 A * 11/1996 Hershey et al. ..... 342/357
5,652,567 A * 7/1997 Traxler ..... 340/552
5,745,049 A * 4/1998 Akiyama et al. ..... 340/870.17
5,845,230 A * 12/1998 Lamberson ..... 702/56
6,297,742 B1 * 10/2001 Canada et al. ..... 340/635

* cited by examiner

*Primary Examiner*—Brent A. Swarthout
(74) *Attorney, Agent, or Firm*—David R. Gildea

(57) ABSTRACT

A cordless machine operation detector including a vibration sensor, a location detector, a data logger, and a transceiver. The vibration sensor detects when a machine is operating by sensing the vibrations that are caused by the machine during operation. The location detector provides a geographical location and includes a time clock for providing time. The data logger uses time from the time clock and an operation indication from the vibration sensor for logging the time for operation of the machine. The data logger also logs a geographical location associated with the machine operation. The transceiver communicates the times and locations of the operation of the machine through an interchange to a tracking monitor. The machine operation detector, the interchange, or the tracking monitor includes an engine time monitor and an alarm sensor. The engine time monitor tracks an accumulated time of operation of the machine. The alarm sensor provides alarms when pre-defined limits of engine time or location are exceeded.

15 Claims, 4 Drawing Sheets

CORDLESS MACHINE OPERATION DETECTOR

BACKGROUND OF THE INVENTION

1. Field of the Invention

The invention relates generally to engine hour meters and more particularly to a cordless machine operation detector using a vibration sensor.

2. Description of the Prior art

Engine hour meters are common in industrial equipment for monitoring engine hours. The owner of the equipment or the owner's representative reads engine hours directly from the meter for triggering scheduled maintenance and/or determining equipment rental charges. In some cases the direct approach works well enough. However, there are several limitations of this approach.

A limitation of the direct approach is that the owner or representative must be present wherever the equipment is in use in order to view the engine hour meter and make a decision on the maintenance. Attempts have been made to resolve this limitation by integrating the engine hour meter with a radio system for transmitting the engine hours to a monitor station. Several manufacturers have designed this capability into their new equipment. However, in order to integrate this capability into existing equipment the wiring of the equipment must be retrofitted in a manner that is specialized for each type of equipment. Such specialized retrofits are often costly and time consuming.

Another limitation of the direct approach for rental equipment is that there is a tendency for the renters to steal hours by disconnecting the hour meter. Various tamper detection systems have been developed in order to resolve this limitation. However, while such systems may inform an owner that tampering has taken place, they do not inform the owner of the number of hours that were missed. Some tamper detection systems apply a lock to prevent the equipment from being used after tampering is detected. However, such systems suffer from the inconvenience of unlocking the equipment after false detections or inadvertent tampering. Moreover, unless the tamper detection systems are manufactured into the equipment as new, they may require a specialized retrofit for the equipment.

There is a need for an apparatus for communicating machine time to a monitor without integration of the apparatus into the machine.

SUMMARY OF THE INVENTION

It is therefore an object of the present invention to provide a cordless machine operation detector that requires no integration with the machine for detecting when the machine is operating.

Briefly, in a preferred embodiment, a machine operation detector of the present invention includes a vibration sensor, a location detector, a data logger, and a transceiver. The machine operation detector mounts to a machine. The vibration sensor detects when the machine is operating by sensing the vibrations that are caused by the machine during operation and provides a machine vibration operation indication. The location detector provides a geographical location and includes a time clock for providing time. The data logger uses time from the time clock and the operation indication from the vibration sensor for logging times of operation of the machine. The data logger also logs geographical locations associated with the machine operation. The transceiver communicates the times and locations of the operation of the machine through an interchange to a tracking monitor. The machine operation detector, the interchange, or the tracking monitor includes an engine time monitor and an alarm sensor. The engine time monitor tracks an accumulated time for the machine vibration operation indication. The alarm sensor provides alarms when pre-defined boundaries of engine time, location, or accumulated time are exceeded. The machine operation detector includes an internal battery. In a first embodiment, the machine operation detector uses the internal battery for cordless operation. In a second embodiment, the detector is connected to switched machine electrical power through the on-off switch for operating the machine. In this case the internal battery enables the alarm sensor to provide an alarm when the external power is off while the vibration sensor indicates that the machine is operating. Operation time of the machine could also be tracked by connecting the device to switched power from the machine key switch.

An advantage of the present invention is that the time and the location of a machine are provided without a requirement for interconnection with electrical wires of the machine.

These and other objects and advantages of the present invention will no doubt become obvious to those of ordinary skill in the art after having read the following detailed description of the preferred embodiments which are illustrated in the various figures.

DETAILED DESCRIPTION OF THE PREFERRED EMBODIMENTS

Figure 1:
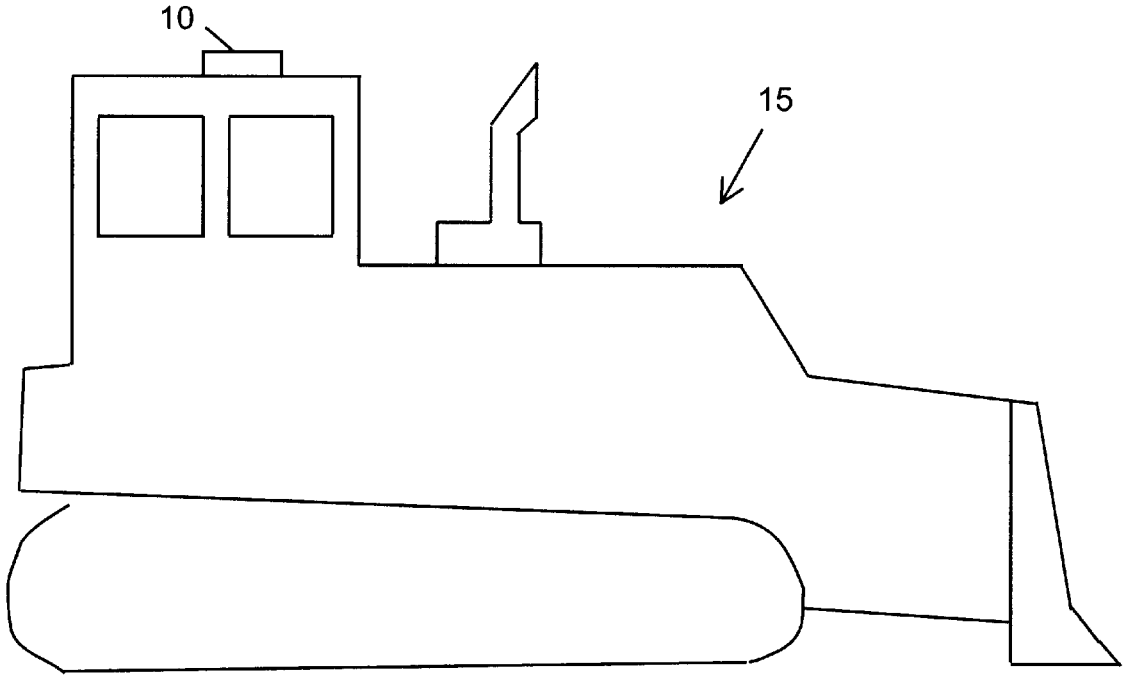
FIG. 1 is a drawing an automatic machine operation detector of the present invention mounted onto a machine.

FIG. 1 is a drawing showing an automatic machine operation detector of the present invention referred to by the reference number 10. The detector 10 is hard mounted on a machine 15 so that vibrations caused by the operation of the machine 15 cause the detector 10 to vibrate. The hard mounting may be a quick release mechanical mechanism or a magnetic mount so that the detector 10 can be moved from one machine 15 to another. The machine 15 is illustrated as a bulldozer. However, the machine 15 can be any vehicle, stationary engine, or the like that produces vibrations when in operation.

Figure 2:
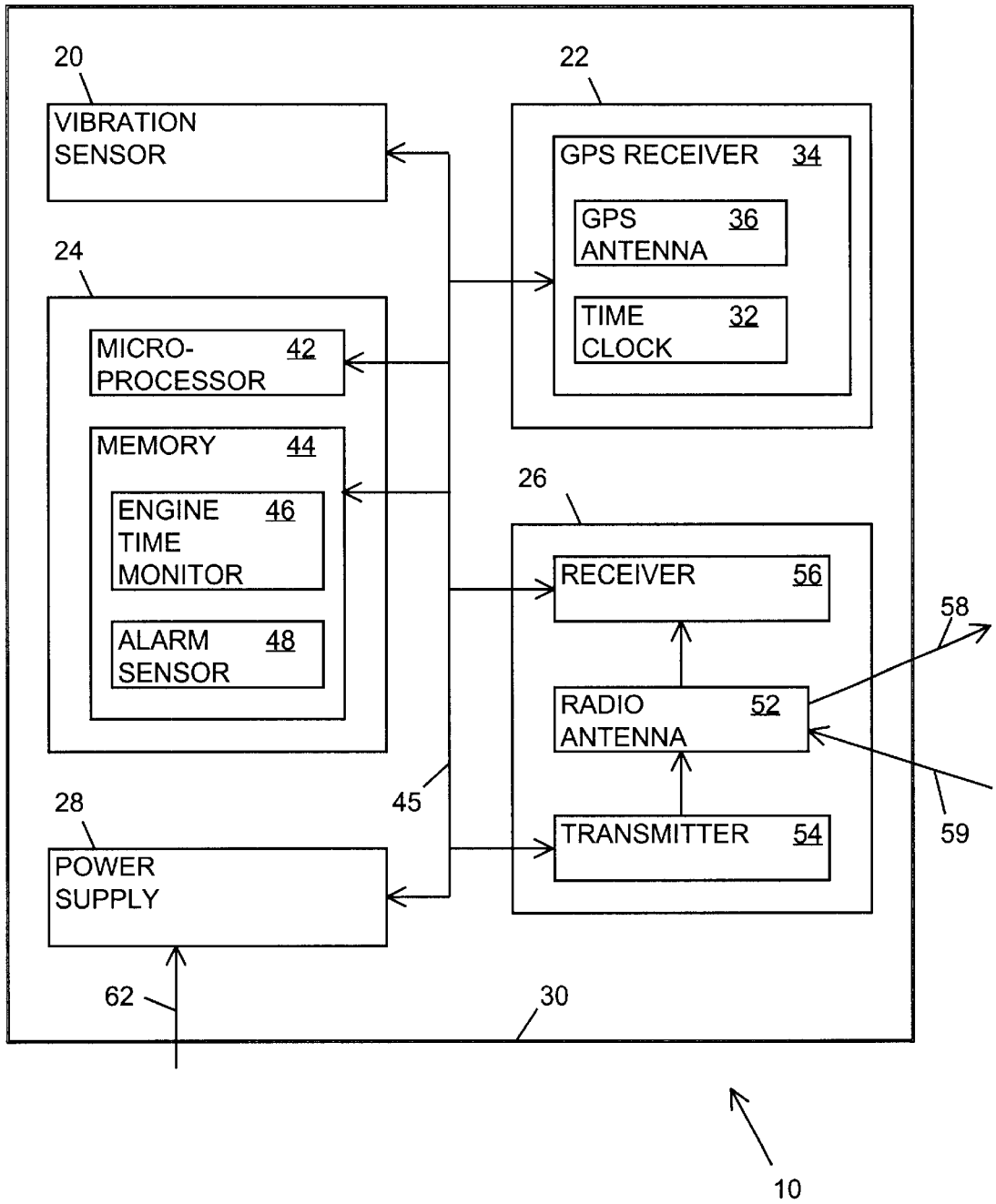
FIG. 2 is a block diagram of the automatic machine operation detector of FIG. 1.

FIG. 2 is a block diagram of the detector 10. The detector 10 includes a vibration sensor 20, a location detector 22, a data logger, 24, a radio transceiver 26, and a power supply 28 enclosed in a housing 30. The vibration sensor 20 is hard mounted to the housing 30 so that when the housing 30 vibrates, the vibration sensor 20 senses the vibration and responds by issuing a machine vibration operation indication signal. A suitable vibration sensor 20 is part number MS 24 manufactured by ASSEMtech Europe Ltd. of the United Kingdom.

The location detector 22 provides a geographical location for the machine operation detector 10 and includes a time clock 32 for providing a local clock time. Preferably, the location detector 22 is a global positioning system (GPS) receiver 34 including a GPS antenna 36. In order to avoid the use of an antenna cable, the GPS antenna 36 mounts inside of the housing 30. The GPS receiver 34 receives GPS signals having location and time determination information from GPS satellites and uses the location and time determination information for providing a geographical location of the GPS antenna 34 and for controlling the local clock time from the time clock 32. Of course, the top section of the housing 30 must be made of a material, such as a polycarbonate plastic, that is configured for passing the GPS signals without significant signal loss. The bottom section of the housing 30 can be polycarbonate, aluminum, or steel. In alternative embodiments, the location detector 22 could use a global orbiting navigation (GLONASS) receiver for providing location and time, an inertial navigation system for providing location, a stable clock for providing time, or the like.

The data logger 24 includes a microprocessor 42 and a memory 44. The microprocessor 42 operates according to instructions in programs in the memory 44 over a signal bus 45 for coordinating the activities of the vibration sensor 20, the location detector 22, and the transceiver 26 and for storing data in the memory 44. In general, signals from the signal bus 45 flow into each of the major circuit blocks and other signals on the signal bus 45 flow out of each of the major circuit blocks of the detector 10.

The programs in the memory 44 optionally include an engine time monitor 46 and an alarm sensor 48. The engine time monitor 46 uses the operation indication signal from the vibration sensor 20 and the local clock time and geographical location from the location detector 22 for logging data for when and where the machine 15 (FIG. 1) is in use. The engine time monitor 46 also maintains an engine time log for accumulating a total operating time when the operation indication signal indicates operational use of the machine 15 (FIG. 1).

The alarm sensor 48 includes pre-defined boundary limits for time, location, and accumulated operating time. When the time passes the time limit, the alarm sensor 48 issues a time alarm signal. When the geographical location passes outside the location limit the alarm sensor 48 issues a location alarm signal. When the accumulated operating time passes the accumulated time limit, the alarm sensor 48 issues an accumulate time alarm signal.

The transceiver 26 includes a radio antenna 52, a radio transmitter 54, and a radio receiver 56. The transmitter 54 transmits radio communication transmit signals 58 through the radio antenna 52. The receiver 56 receives radio communication receive signals 59 through the radio antenna 52. In order to avoid the use of an antenna cable, the radio antenna 52 mount's inside of the housing 30. Preferably, the radio antenna 52, transmitter 54, and receiver 56 of the transceiver 26 are an advanced mobile phone service (AMPS) cellular telephone. However, other types of cellular telephones, or terrestrial or satellite radio transceivers can be used. Further, the transceiver 26 may include a gateway for a radio link that is part of an Internet based access system involving the use of Internet Protocols. One such gateway using unlicensed radio bands, is commercially available from Metricom, San Jose, Calif. through its "Ricochet" product offering. Another Internet access gateway is commercially available from the Palm Computing Co. of San Jose, Calif.

The receiver 56 receives the receive signal 59 for polling the machine operation detector 10 for times of operation, locations of operation, and/or accumulated operation time. The transceiver 26 transmits the transmit signal 58 in three modes. In a first mode the transmit signal 58 is transmitted in response to an alarm signal from the alarm sensor 48. The transmit signal 58 includes information for the type of alarm condition causing the alarm signal. In a second mode, the transmit signal 58 includes times and locations of operation and accumulate operational time transmitted periodically according to preset times from the time clock 32. In a third mode, the transmit signal 58 responds with the information requested in the receive signal 59 for polling the detector 10.

The power supply 28 includes an internal battery for powering the vibrations sensor 20, the location detector 22, the data logger 24, and the radio transceiver 26. An optional port 62 enables the power supply 28 to use an external source of power in place of the battery or for recharging the battery. Optionally, the alarm sensor 48 provides a disconnect alarm signal when the external source of power is not connected while the operation indication signal indicates that the machine 15 (FIG. 1) is in use.

Figure 3:
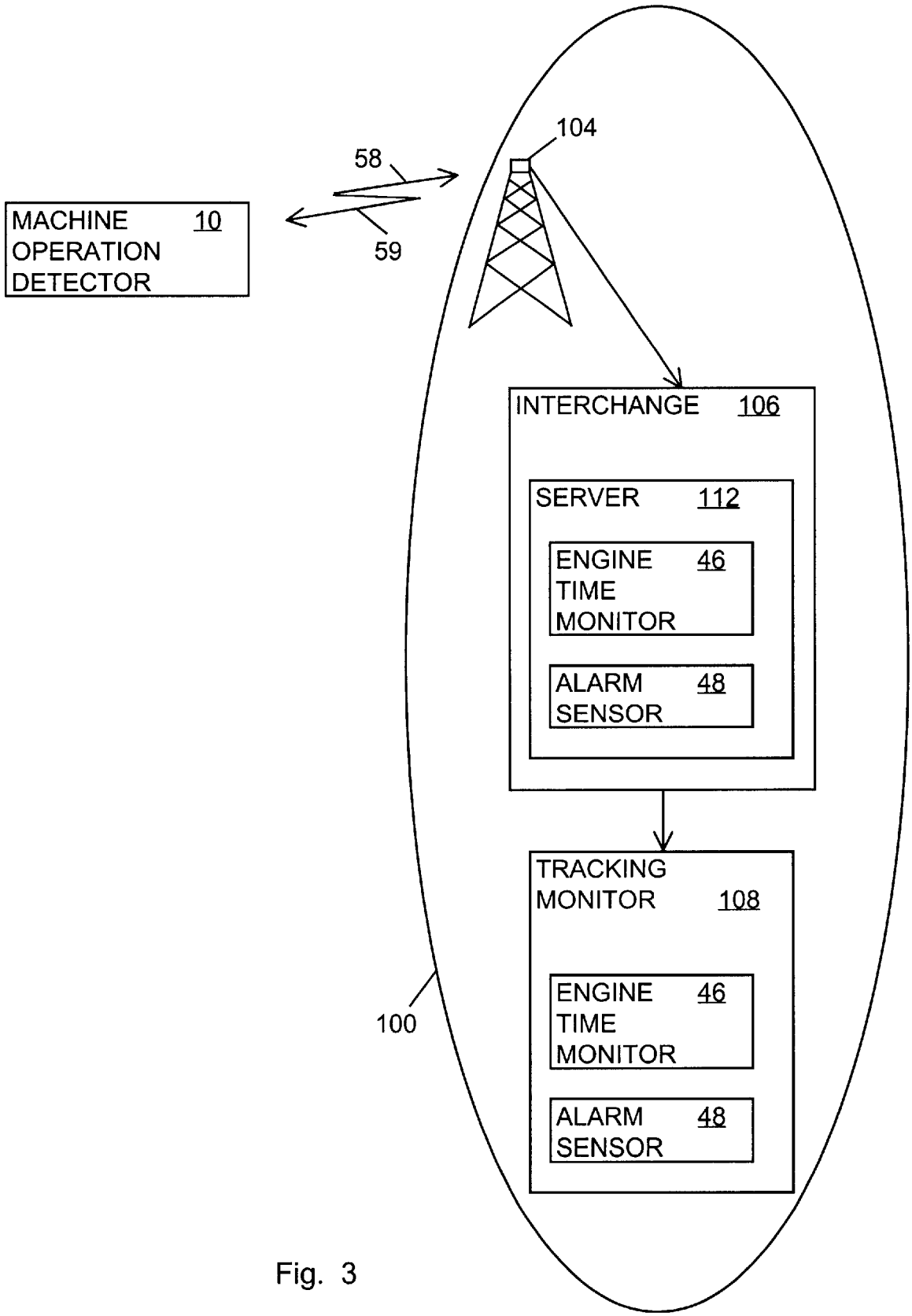
FIG. 3 is a first block diagram of a tracking system for the automatic machine operation detector of claim 1.
Figure 4:
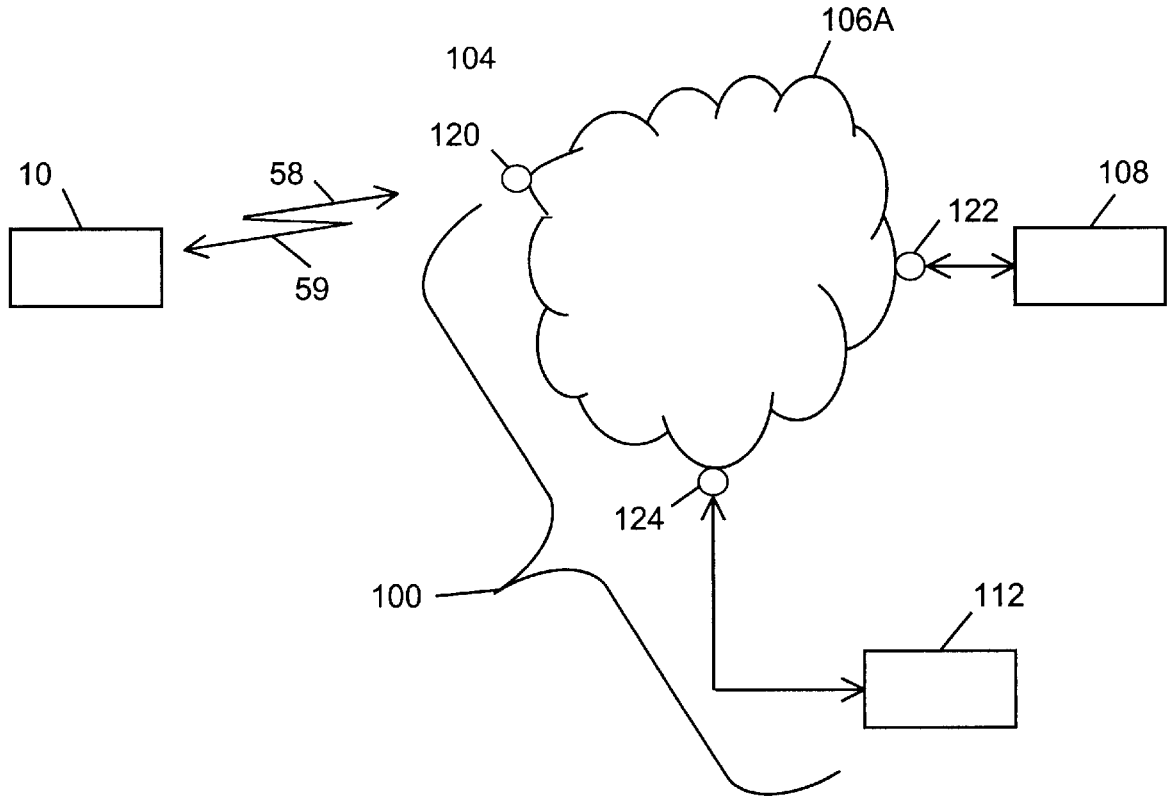
FIG. 4 is a second block diagram of a tracking system for the automatic machine operation detector of claim 1.

FIGS. 3 and 4 are block diagrams showing the machine operation detector 10 and a tracking system of the present invention referred to by the reference number 100. The tracking system 100 includes a communication signal transceiver 104, an interchange 106 or a wide area network (WAN) 106A, and a tracking monitor 108. The interchange 106 and WAN 106A use a telephone system with switched dedicated circuits or packet transmissions using the circuits for only as long as the packets are being transmitted.

Referring to FIG. 3, the communication signal transceiver 104 receives the transmit signals 58 from the machine operation detector 10 and passes the information in the transmit signals 58 through the interchange 106 to the tracking monitor 108. Information intended to go to the machine operation detector 10 is passed from the tracking monitor 10 through the interchange 106 and then transmitted from the communication signal transceiver 104 in the receive signals 59. The interchange 106 typically includes telephone lines and switches and may include a server 112 for a web site that is accessible, preferably through the Internet, from the tracking monitor 108 or for emailing information to the tracking monitor 108.

The tracking monitor 108 typically includes a computer processor, a memory, a display, and a user entry for enabling a centralized user to monitor several of the detectors 10 distributed at several remote sites. In a typical application the user represents the owner of the machine 15 (FIG. 1)

Programs for the engine time monitor 46 and alarm sensor 48 described above can be stored either in machine operation detector 10, the server 112, or the tracking monitor 108 for logging accumulated time or providing alarm indications when the operation of the machine 15 (FIG. 1) appears to be outside of pre-defined time, location, or accumulated time boundary limits.

Referring to FIG. 4, the machine operation detector 10 transmits signals 58 having transmit data from the detector 10 and receives signals 59 having receive data intended to be received by the detector 10 from the communication signal transceiver 104. The transceiver 104 is coupled to an Internet service provider (ISP) 120 for passing transmit and receive data through the WAN 106A. In a preferred embodiment, the WAN 106A is the Internet. However, the WAN 106A can be embodied by other mediums, for example frame relay (FR), packet switched telephone network (PSTN), and asynchronous transfer mode (ATM) cell switching networks. The transceiver 26 (FIG. 1) in the detector 10 includes a gateway or appliance for applying error detection and correction and the required protocols and headers for the WAN 106A. The headers include the required addressing and security codes. The tracking monitor 108 connects into the WAN 106A through another ISP 122. The server 112 connects with the WAN 106 at port 124.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A detector for detecting machine operation, comprising:

a vibration sensor coupled to a machine for sensing vibration of said machine and providing an operation indication in response to said vibration for indicating that said machine is operating;

a location detector for determining a geographical location of said machine;

a clock for providing times;

an engine time monitor coupled to the clock and the vibration sensor for using said times associated with said operation indication for determining an accumulated time of operation; and a transmitter coupled to the vibration sensor, the location detector, the clock, and the engine time monitor for transmitting a transmit signal, said transmit signal including information for said operation indication, said location, times associated with said operation indication, and said accumulated time of operation.

2. The detector of claim 1, wherein:

the location detector includes a global positioning system (GPS) receiver.

3. A detector for detecting machine operation, comprising:

a vibration sensor for sensing vibration of a machine for providing an indication of said machine operation;

an engine time monitor coupled to the vibration sensor for determining an accumulated time of said operation indication;

an alarm sensor coupled to the engine time monitor for providing an accumulated time alarm when said accumulated time passes a pre-selected accumulated time limit; and a transmitter for transmitting a transmit signal having-said accumulated time alarm.

4. The detector of claim 3, further comprising:

a port for receiving an indication of on-off power for operating the machine; and wherein:

the alarm sensor is coupled to the port for providing a disconnect alarm when said on-off power indication indicates that said machine is off while said operation indication from the vibration sensor indicates that said machine is operating; and said transmit signal includes information for said disconnect alarm.

5. A method for detecting machine operation, comprising steps of:

sensing vibration of a machine;

providing an operation indication in response to said vibration indicative that said machine is in operation;

determining an accumulated time of said operation indication;

issuing an accumulated time alarm when said accumulated time passes a pre-selected accumulated time limit; and transmitting a transmit signal having said accumulated time alarm.

6. The method of claim 5, further comprising steps of:

receiving an indication of on-off power for operating the machine; and generating a disconnect alarm when said on-off power indication indicates that said machine is off while said machine vibration operation indication indicates that said machine is operating; wherein:

said transmit signal includes information for said disconnect alarm.

7. A system for detecting machine operation, comprising:

a machine operation detector including a vibration sensor coupled to a machine for sensing vibration of said machine and providing an operation indication in response to said vibration for indicating that said machine is operating, a location detector for determining a geographical location of said machine, a clock for providing times, an engine time monitor coupled to the clock and the vibration sensor for using said times associated with said operation indication for determining an accumulated time of operation, and a transmitter for transmitting a transmit signal having information for said location, said operation indication, said times associated with said operation indication and said accumulated time; and a tracking system including a receiver for receiving said transmit signal.

8. The system of claim 7, wherein:

the location detector includes a global positioning system (GPS) receiver.

9. A system for detecting machine operation, comprising:

a machine operation detector including a vibration sensor coupled to said machine for sensing vibration of said machine and providing an operation indication in response to said vibration for indicating that said machine is operating, an engine time monitor for receiving said operation indication and determining an accumulated time of operation, an alarm sensor coupled to the engine time monitor for providing an alarm when said accumulated time passes a pre-selected time limit; and a transmitter for transmitting a transmit signal having said alarm; and a tracking system including a receiver for receiving said transmit signal.

10. The system of claim 9, wherein:

the machine operation detector further includes a port for receiving an indication of on-off power for operating the machine and an alarm sensor for providing a disconnect alarm when said on-off power indication indicates that said machine is off while said operation indication from the vibration sensor indicates that said machine is operating.

11. The system of claim 9, wherein:

the tracking system includes a communications transceiver connected into a wide area network (WAN).

12. The system of claim 11, wherein:

the WAN includes a transceiver for connecting said machine operation data into the worldwide telephone network.

13. The system of claim 11, wherein:

the WAN includes an Internet service provider (ISP) for connecting said machine operation data into the Internet.

14. The system of claim 13, wherein:

the WAN further includes a server having a web site for making said machine operation data accessible to a user having another ISP.

15. A system for detecting machine operation, comprising:

a machine operation detector including a vibration sensor coupled to said machine for sensing vibration of said machine and providing a machine vibration operation indication in response to said vibration, and a transmitter coupled to the vibration sensor for transmitting a transmit signal having information derived from said operation indication; and a tracking system for receiving said transmit signal, the tracking system having an engine time monitor for tracking an accumulated time for said operation indication and an alarm sensor for providing an alarm when said accumulated time passes a pre-selected time limit.

* * * * *